US007699198B2

(12) United States Patent
Sirichai et al.

(10) Patent No.: US 7,699,198 B2
(45) Date of Patent: Apr. 20, 2010

(54) ATTACHMENT MECHANISM FOR USE WITH A PORTABLE ELECTRONIC DEVICE, AND METHOD OF MANUFACTURING SAME

(75) Inventors: Saharut Sirichai, Los Angeles, CA (US); John Wadsworth, Los Angeles, CA (US); Ernesto Quinteros, Los Angeles, CA (US); Vijendra Nalwad, Newbury Park, CA (US); Mitchell Suckle, Long Beach, CA (US)

(73) Assignee: Belkin International, Inc., Playa Vista, CA (US)

( * ) Notice: Subject to any disclaimer, the term of this patent is extended or adjusted under 35 U.S.C. 154(b) by 1355 days.

(21) Appl. No.: 11/120,390

(22) Filed: May 2, 2005

(65) Prior Publication Data

US 2006/0243772 A1 Nov. 2, 2006

(51) Int. Cl.

| | |
|---|---|
| ***A45C 1/04*** | (2006.01) |
| ***B65H 75/40*** | (2006.01) |
| ***B65H 75/44*** | (2006.01) |
| ***B65H 75/38*** | (2006.01) |

(52) U.S. Cl. ..... 224/666; 224/667; 224/668; 224/670; 224/671; 224/674; 224/162; 242/400.1; 242/405.1

(58) Field of Classification Search ..... 224/666, 224/667, 668, 670, 671, 674, 162, 400, 400.1, 224/405.1, 588, 588.1; 242/360, 326.2, 324.3, 242/159, 160.3, 164, 361, 575.1, 400, 400.1, 242/405.1, 588, 588.1; D3/218; 24/3.11, 24/3.12

See application file for complete search history.

(56) References Cited

U.S. PATENT DOCUMENTS

| | | | | |
|---|---|---|---|---|
| 4,730,872 | A | 3/1988 | Golzer | |
| 4,821,934 | A * | 4/1989 | Alessi et al. | 224/667 |
| 4,896,805 | A * | 1/1990 | Klaczak et al. | 224/236 |
| 5,038,985 | A | 8/1991 | Chapin et al. | |
| 5,123,525 | A * | 6/1992 | Orlowski | 206/5 |
| 5,297,318 | A * | 3/1994 | Adolphson et al. | 24/3.1 |
| 5,379,490 | A * | 1/1995 | Wandt et al. | 24/3.11 |
| 5,528,770 | A * | 6/1996 | Castilla et al. | 340/7.63 |
| D385,417 | S * | 10/1997 | White et al. | D3/249 |

(Continued)

OTHER PUBLICATIONS

Internet: Nokia Leather Case With Swivel Clip§; CTU-113R; http://www.nokiausa.com/acc_image/1,1591,Q1RVLTExM1I=|||~YWNjX2N0dTExM3JfcHJk LMPWZw=; retrieved from the internet on Mar. 2, 2005.

(Continued)

*Primary Examiner*—Nathan J Newhouse
*Assistant Examiner*—Lester L Vanterpool
(74) *Attorney, Agent, or Firm*—Bryan Cave LLP

(57) ABSTRACT

An attachment mechanism for use with a portable electronic device (101) includes a case (110) having a first surface (211) and a second surface (111), where the first surface and the second surface define therebetween a space (105) capable of receiving the portable electronic device. The attachment mechanism further includes a clip (120) attached to the second surface of the case. The clip includes a body (221) adjacent to the second surface, a first extension (222) spaced apart from and extending toward the second surface, and a second extension (223) also spaced apart from and extending toward the second surface. The second piece creates a first pocket (231) between the case and the clip, and the second piece creates a second pocket (232) between the case and the clip.

23 Claims, 7 Drawing Sheets

U.S. PATENT DOCUMENTS

| | | | | |
|---|---|---|---|---|
| 5,893,497 | A * | 4/1999 | Schaiewitz | 224/182 |
| 5,898,647 | A | 4/1999 | Goradesky et al. | |
| 6,264,079 | B1 * | 7/2001 | Skaggs | 224/193 |
| D474,016 | S * | 5/2003 | Childers | D3/221 |
| 6,905,051 | B2 * | 6/2005 | Chee | 224/197 |
| 7,110,802 | B1 * | 9/2006 | Kim et al. | 455/575.6 |
| 2003/0106917 | A1 | 6/2003 | Shetler et al. | |
| 2004/0079776 | A1 | 4/2004 | Bauer | |
| 2004/0155079 | A1 | 8/2004 | Shelter et al. | |

OTHER PUBLICATIONS

Internet: Nokia Vertical Hand-Stitched Leather Pouch§; CTU-414R; http://www.nokiausa.com/acc_image/1,1591,Q1RVLTQxNFI=|||~YWNjX2N0dTQx NHJfcHJk LmpwZw=; retrieved from the internet on Mar. 2, 2005.

Internet: Nokia Black Latch with Belt Clip§; CNT-433R; http://www.nokiausa.com/acc_image/1,1591,Q05ULTQzM1I=|||~YWNjX2NudDQzM19wcmQu anBn|~Uk; retrieved from the internet on Mar. 2, 2005.

Internet: Motorola Leather Functional Case—VLV31; http://commerce.motorola.com/cgi-bin/ncommerce3/ProductDisplay?prrfnbr=257090&prmenbr=126&acc; retrieved from the internet on Mar. 2, 2005.

Internet: Cell Phone Universal Swivel Belt Clip; http://www.advantageservice.net/cellclip.htm; retrieved from the internet on Mar. 2, 2005.

Internet: Vertical Leather Carry Case/Pouch with Belt Clip for Nokia 8310, 8390, 6510—Dark Brown; http://www.suntekstore.com/sh-pc-056nokdb.html; retrieved from the internet on Mar. 2, 2005.

Internet: GUMP Horizontal Leather Carry Case/Pouch with Belt Clip-Medium; http://www.suntekstore.com/sh-hc-206m.html; retrieved from the internet on Mar. 2, 2005.

* cited by examiner

ATTACHMENT MECHANISM FOR USE WITH A PORTABLE ELECTRONIC DEVICE, AND METHOD OF MANUFACTURING SAME

FIELD OF THE INVENTION

This invention relates generally to electronic device portability, and relates more particularly to the transport, storage, and protection of portable electronic devices.

BACKGROUND OF THE INVENTION

Cellular telephones, MP3 players, pocket computers, and other portable electronic devices have become so popular and are in such widespread use that it is now almost unusual to encounter a person who is not carrying at least one such device. Many portable electronic devices, including all of those mentioned above, are at least capable of emitting sound, and thus are quite often equipped with headphones that enable the sound to be listened to privately. Other cables or cords in addition to those connected to headphones are sometimes also used in conjunction with portable electronic devices. These headphone and other cords are easily tangled and broken, and are, in general, hard to manage. Accordingly, there exists a need for a mechanism capable of safely and conveniently storing and carrying a portable electronic device while also managing any cords that are used therewith.

BRIEF DESCRIPTION OF THE DRAWINGS

The invention will be better understood from a reading of the following detailed description, taken in conjunction with the accompanying figures in the drawings in which.

Figure 1:
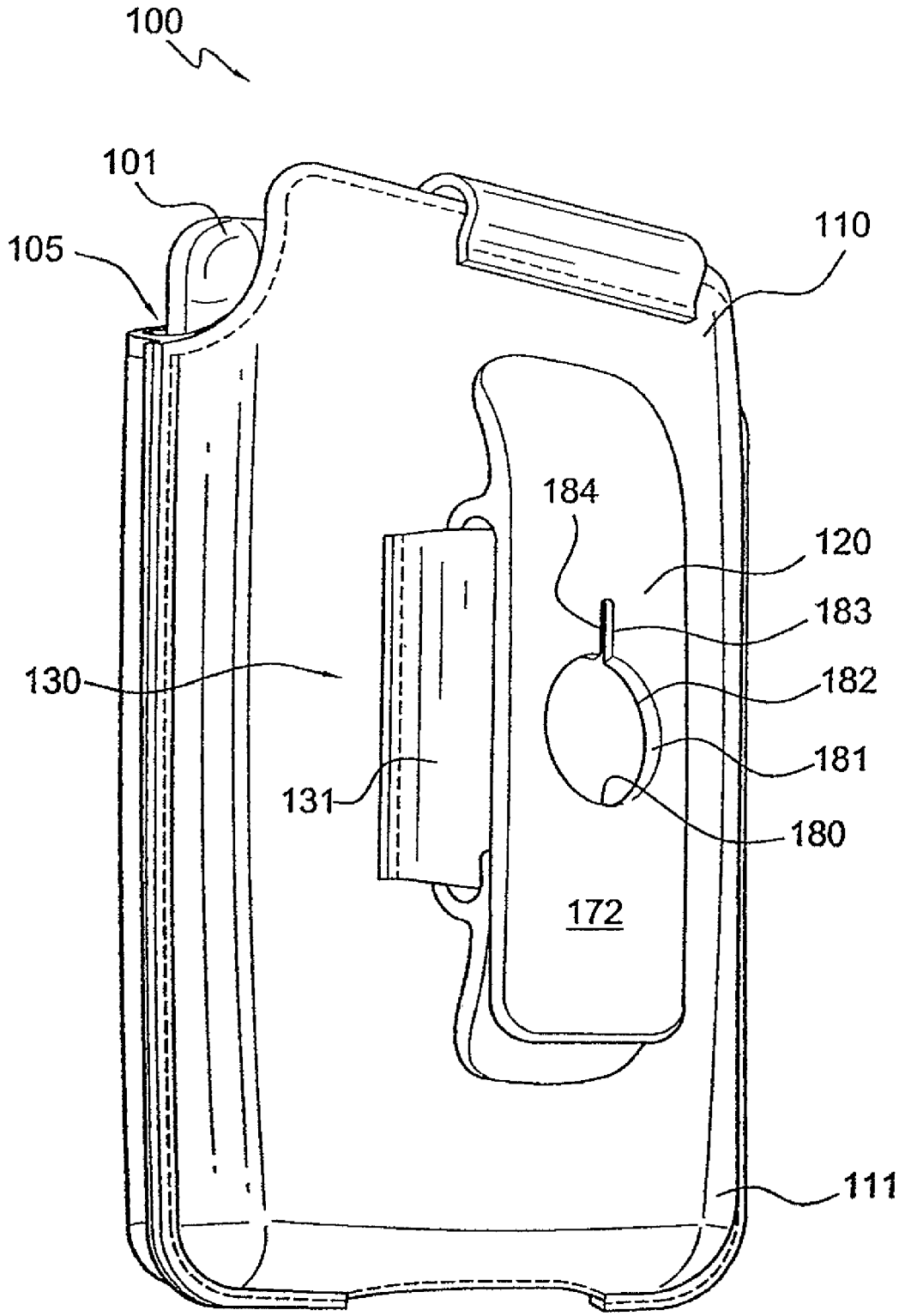
FIG. 1 is a perspective view of an attachment mechanism for use with a portable electronic device according to an embodiment of the invention.

For simplicity and clarity of illustration, the drawing figures illustrate the general manner of construction, and descriptions and details of well-known features and techniques may be omitted to avoid unnecessarily obscuring the invention. Additionally, elements in the drawing figures are not necessarily drawn to scale. For example, the dimensions of some of the elements in the figures may be exaggerated relative to other elements to help improve understanding of embodiments of the present invention. The same reference numerals in different figures denote the same elements.

The terms "first," "second," "third," "fourth," and the like in the description and in the claims, if any, are used for distinguishing between similar elements and not necessarily for describing a particular sequential or chronological order. It is to be understood that the terms so used are interchangeable under appropriate circumstances such that the embodiments of the invention described herein are, for example, capable of operation in sequences other than those illustrated or otherwise described herein. Furthermore, the terms "comprise," "include," "have," and any variations thereof, are intended to cover a non-exclusive inclusion, such that a process, method, article, or apparatus that comprises a list of elements is not necessarily limited to those elements, but may include other elements not expressly listed or inherent to such process, method, article, or apparatus.

The terms "left," "right," "front," "back," "top," "bottom," "over," "under," and the like in the description and in the claims, if any, are used for descriptive purposes and not necessarily for describing permanent relative positions. It is to be understood that the terms so used are interchangeable under appropriate circumstances such that the embodiments of the invention described herein are, for example, capable of operation in other orientations than those illustrated or otherwise described herein. The term "coupled," as used herein, is defined as directly or indirectly connected in an electrical, mechanical, or other manner.

DETAILED DESCRIPTION OF THE DRAWINGS

In one embodiment of the invention, an attachment mechanism for use with a portable electronic device comprises a case having a first surface and a second surface, where the first surface and the second surface define therebetween a space capable of receiving the portable electronic device. The attachment mechanism also comprises a clip attached to the second surface of the case. The clip comprises a first piece adjacent to the second surface, a second piece spaced apart from and extending toward the second surface, and a third piece also spaced apart from and extending toward the second surface. The second piece creates a first pocket between the case and the clip, and the second piece creates a second pocket between the case and the clip.

Figure 2:
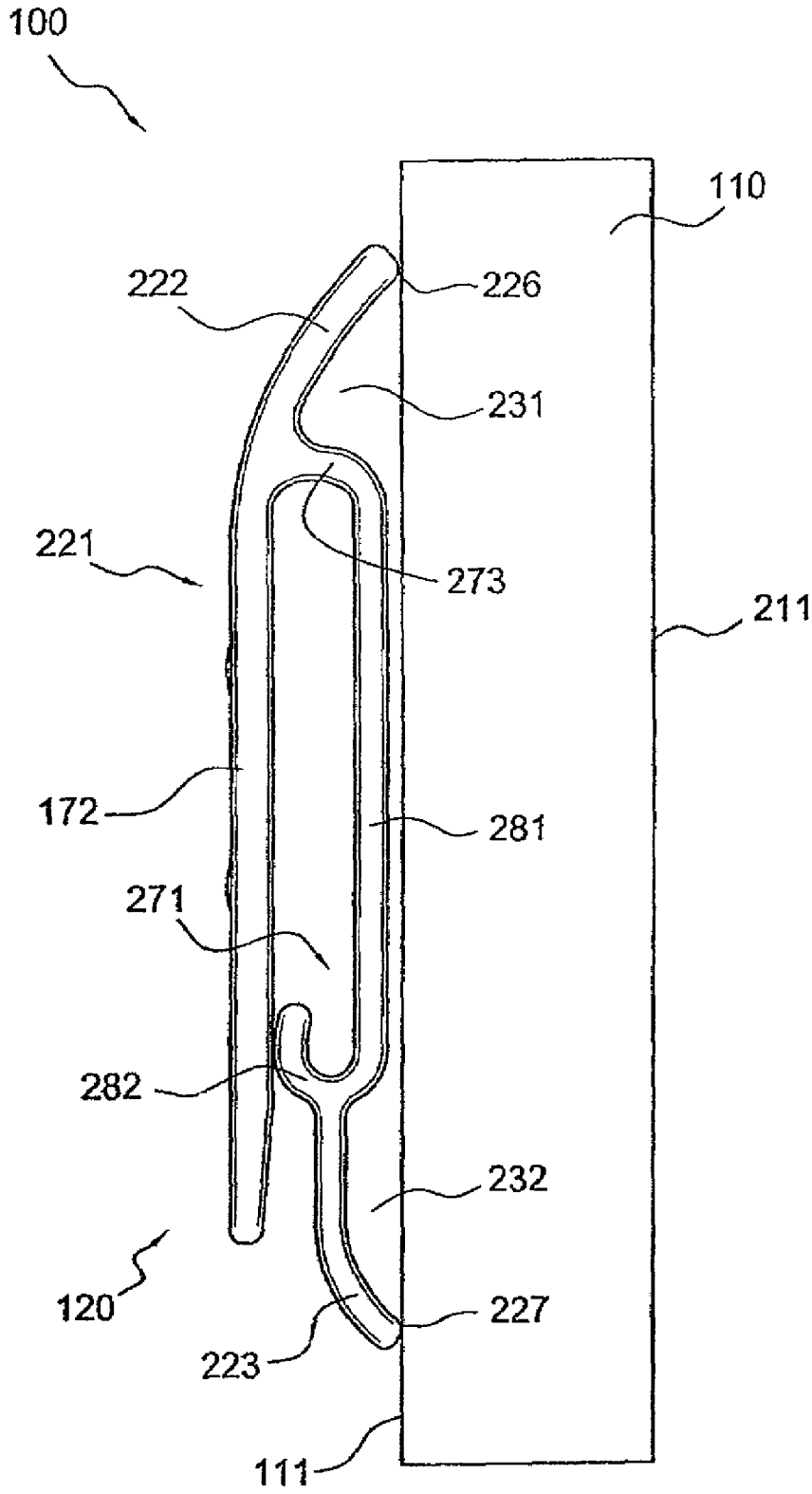
FIG. 2 is a side view of the attachment mechanism of FIG. 1 according to an embodiment of the invention.

FIG. 1 is a perspective view of an attachment mechanism 100 for use with a portable electronic device 101 (only a small portion of which is shown) according to an embodiment of the invention. FIG. 2 is a side view of attachment mechanism 100, with some details omitted for the sake of clarity; according to an embodiment of the invention. For example, FIG. 2 does not illustrate the components of attachment mechanism 100 that serve to attach the case to the clip. Those components are visible in FIG. 1, however, and are described below.

Portable electronic device 101 can be, for example, an MP3 player, a cellular telephone, a pager, a wireless handheld device, a handheld computing device such as a pocket PC, or the like. As mentioned above in the background section, the use of many of these portable electronic devices requires, or is enhanced by, a cord such as a headphone cord. Although it is well suited for use with a wide variety of portable electronic devices, attachment mechanism 100 is particularly well suited for use with a portable electronic device having a headphone or other cord because attachment mechanism 100 provides for the management of such cords, as described in more detail below.

As illustrated in FIGS. 1 and 2, attachment mechanism 100 comprises a case 110 and a clip 120. Case 110 may be formed of a soft material, such as leather or the like, or of a hard material, such as plastic or the like. Case 110 comprises a surface 111 and a surface 211. Surface 111 and surface 211 define a space 105 therebetween. Space 105 is capable of receiving portable electronic device 101. Clip 120 is attached to surface 111 and comprises a body 221 adjacent to surface 111, an extension 222 spaced apart from and extending toward surface 111, and an extension 223 spaced apart from and extending toward surface 111. By extending toward surface 111, extension 222 creates a pocket 231 between case 110 and clip 120. Similarly, extension 223 creates a pocket 232 between case 110 and clip 120. Pockets 231 and 232 are suitable for and capable of receiving portions of a headphone cord or the like (not shown in FIG. 1 or 2) as it is wound around clip 120.

FIG. 2 illustrates attachment mechanism 100 in a relaxed posture, where, for example, neither case 110 nor clip 120 are being flexed or deformed as one or both might be when, for example, a cord is being wound around clip 120. In that posture and in the illustrated embodiment, extension 222 touches surface 111 at a point 226, and extension 223 touches surface 111 at a point 227, thus helping to maintain the cord (not shown in FIG. 2) within pockets 231 and 232.

A variety of configurations for clip 120 are possible; the configuration shown in FIGS. 1 and 2 is but a single example. That configuration shows body 221 as comprising a section 271, a section 172, and a section 273 that connects section 271 and section 172. Section 271 is adjacent to surface 111. Section 271 comprises a segment 281 and a segment 282. The boundaries separating sections 271, 172, and 273, as well as those separating segments 281 and 282, are somewhat arbitrary, and their exact locations need not be specified. Indeed, in at least one embodiment, the boundaries are imaginary because clip 120 is molded as a single, continuous piece with no separation between any of the sections or segments under discussion here. As an example, an injection molding process may be used to form clip 120. In one embodiment, clip 120 may be formed from acrylonitrile butadiene styrene (ABS) or a similar material, which material is chosen in part for its flexibility.

Segment 281 is substantially straight and flat and can be mounted flush with surface 111, and segment 282 extends away from segment 281 toward section 172. In one embodiment, segment 282 is long enough to touch section 172, while section 172 is flexible enough to be pulled away from segment 282. This configuration allows clip 120 to be clipped onto a belt, a strap of a backpack, or the like, by separating section 172 and segment 282 as described, passing the belt or the like through the gap thus created, then releasing section 172 and segment 282 such that they move toward each other and either touch or lie so close to each other that they develop a firm grip on the belt or the like.

Of course, as was alluded to above, clip 120 can also exist in a variety of configurations other than that just described. As just one example of such an alternate embodiment, the curves illustrated in FIG. 2 could be replaced with sharp angles, thus giving clip 120 a boxier appearance.

Case 110 further comprises a patch 130 attached to surface 111 and passing between section 271 and section 172 of clip 120. In one embodiment, patch 130 is sewn to surface 111 of case 110. In the same or another embodiment, a spacer 131 is located between patch 130 and surface 111, and patch 130 is sewn to case 110 by passing stitching through patch 130, spacer 131, and surface 111. Although a variety of sizes, materials, and configurations are acceptable, in a particular embodiment, spacer 131 is constructed of cardboard that can be, for example, approximately 1.5 millimeters thick. If desired, spacer 131 may be painted to match the color of case 110 or another component of attachment mechanism 100.

In an embodiment similar to the one just described, patch 130 is again positioned between sections 271 and 172 of clip 120, and clip 120 is attached to case 110 using rivets (not shown) that pass through patch 130 and surface 111 of case 110. In a non-illustrated embodiment, clip 120 is attached to case 110 using an adhesive. As an example of that non-illustrated embodiment, an adhesive substance may be applied to segment 281, after which segment 281 may be adhered to surface 111 of case 110. Other attachment techniques, as known in the art, may also be used to attach clip 120 to case 110.

Section 172 comprises an inside perimeter 180, which in turn comprises a portion 181 that defines an opening 182 in section 172, and which further comprises a portion 183 that defines an opening 184 in section 172. As illustrated, opening 182 communicates with opening 184, and opening 184 is narrower than opening 182. Inside perimeter 180, with its components as described above, functions with a mounting piece (to be described below) to allow attachment mechanism 100 to be mounted on a surface such as a computer monitor, a wall, or the like.

Figure 3:
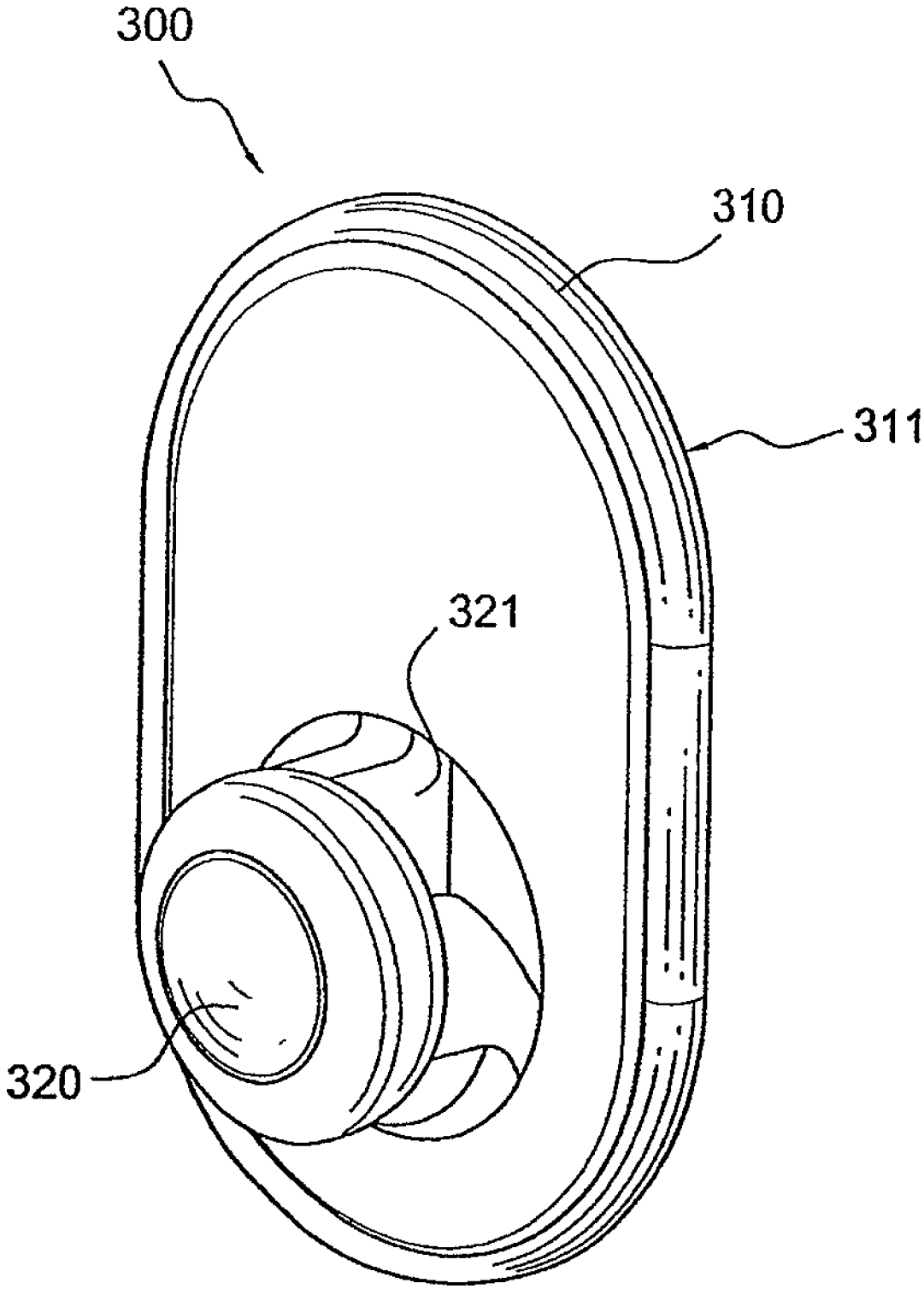
FIG. 3 is a perspective view of a mounting piece that forms part of the attachment mechanism of FIG. 1, according to an embodiment of the invention.

FIG. 3 is a perspective view of a mounting piece 300 that forms part of attachment mechanism 100, according to an embodiment of the invention. As illustrated in FIG. 3, mounting piece 300 comprises a backing piece 310 and a protrusion 320 extending from backing piece 310. Backing piece 310 has a surface 311. In one embodiment, surface 311 is a self-adhesive surface. In another embodiment, surface 311 is permanently or non-permanently attached to a mounting arm or other mounting device. As illustrated, backing piece 310 is substantially flat so as to allow attachment thereof to any of the surfaces or locations mentioned above, as well to other suitable surfaces or locations not explicitly described herein.

Referring again to FIG. 1, and still to FIG. 3, opening 182 in clip 120 is capable of receiving protrusion 320. In the illustrated embodiment, mounting piece 300 further comprises a locking piece 321 extending from protrusion 320, and opening 184 is capable of receiving locking piece 321 such that clip 120 is prevented from rotating about protrusion 320 when locking piece 321 is located in opening 184. Still referring to the illustrated embodiment, locking piece 321 is placed in opening 184 by the same action that places protrusion 320 in opening 182, so that protrusion 320 cannot be in opening 182 unless locking piece 321 is in opening 184. Such an arrangement may increase the stability of the illustrated embodiment over that of other embodiments of attachment mechanism 100 where locking piece 321 is not so used. The tightness of the fit between opening 182 and locking piece 321 may be adjusted to provide friction for a more secure fit. Likewise, the fit between a portion of protrusion 320 and a portion of section 172 may be adjusted to make a more secure fit between those elements.

In a particular embodiment, mounting piece 300 is used by attaching surface 311 to a suitable surface or location such as a wall of a building, a vehicle dashboard, a computer monitor, a garment, a bag, or any other surface or location where it may be desirable to mount case 110. In one embodiment, mounting piece 300 is sewn into or otherwise attached to a garment, a bag, or the like. In an embodiment where surface 311 is self-adhesive, a non-adhesive backing may be placed over surface 311 until mounting piece 300 is brought to the point of attachment, at which time the non-adhesive backing may be removed and mounting piece 300 may be attached. Following such attachment, clip 120 is placed on mounting piece 300 by inserting protrusion 320 into opening 182. Case 110, and portable electronic device 101, if it is stored therein, is then conveniently held in place at the location of mounting piece 300. Further mounting stability may be obtained by forcing opening 184 of clip 120 over locking piece 321. Case 110 may be removed from mounting piece 300 by removing locking piece 321 from opening 184, and by removing protrusion 320 from opening 182. Mounting piece 300, following its initial attachment to the suitable surface as described above, in one embodiment, would stay in place permanently, and in another embodiment, would be removably attachable to the suitable surface such that mounting piece 300, after the removal of case 110, could itself be removed from the suitable surface and reattached elsewhere.

In one or more non-illustrated embodiments, mounting piece 300 or a similar piece works with a mounting arm or other mounting device to allow additional mounting possibilities. In a particular one of these non-illustrated embodiments, mounting piece 300 is attached to a mounting arm suitable for attachment to a vehicle's windshield or the like. The mounting arm can be attached at one of its ends to a windshield, while another of the mounting arm's ends can be attached to mounting piece 300. In a different particular non-illustrated embodiment, mounting piece 300 or a similar piece is attached to a mounting device adapted for some other environment, such as a vehicle cup holder, a desktop, or the like. In general, mounting piece 300 may be used as a means of integrating attachment mechanism 100 with any suitable mounting system, such that case 110 may be mounted using any such mounting system. The mating of clip 120 and mounting piece 300 is depicted in FIGS. 6 and 7.

Figure 4:
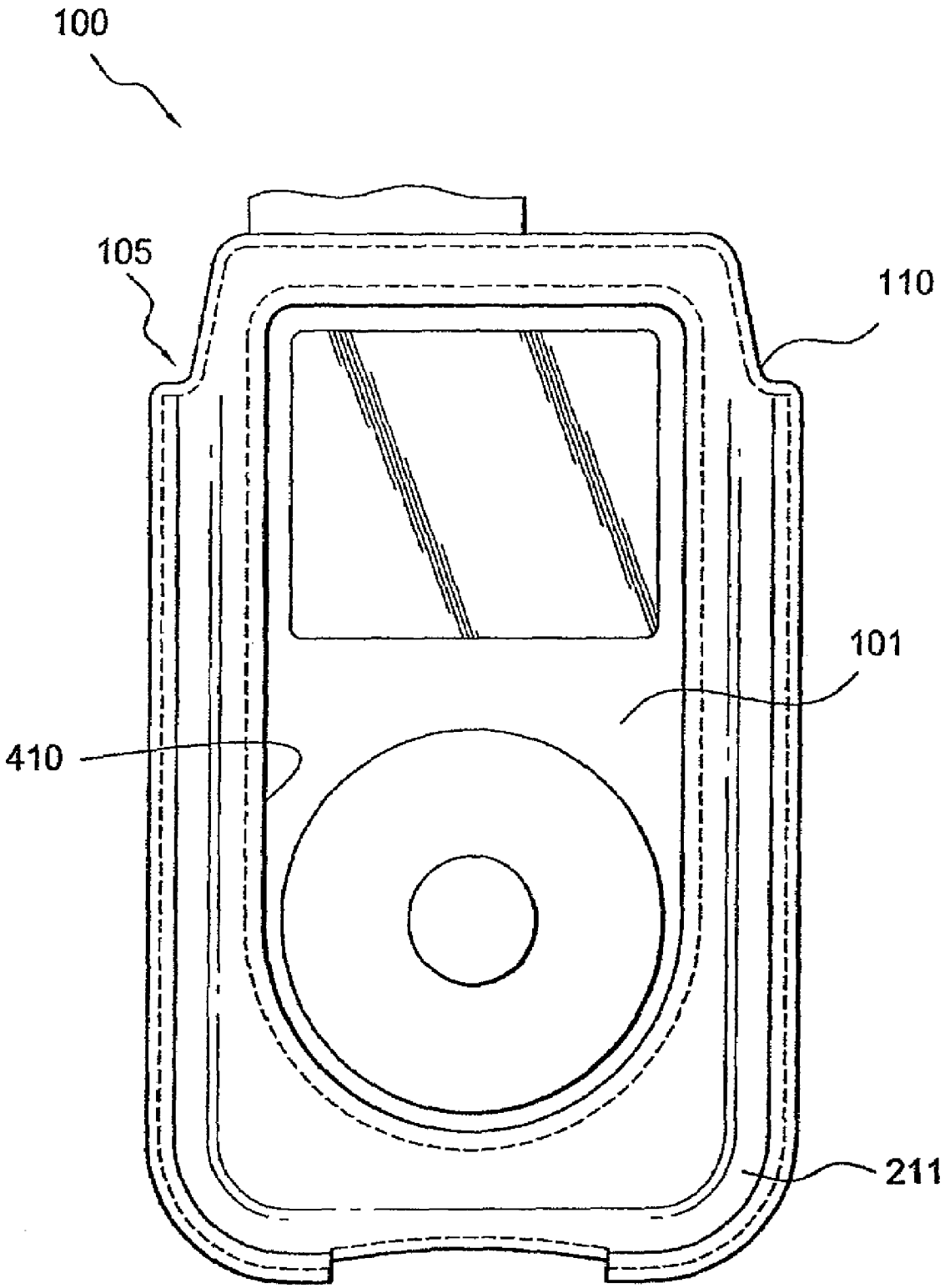
FIG. 4 is a front view of the attachment mechanism of FIG. 1 according to an embodiment of the invention.

FIG. 4 is a front view of attachment mechanism 100 according to an embodiment of the invention. As illustrated in FIG. 4, surface 211 of case 110 comprises a viewing window 410. In one embodiment, viewing window 410 is covered with a see-through material such as a transparent plastic. In another embodiment, viewing window 410 is open and is not covered by any material. An advantage of the first described embodiment is that the material provides protection from moisture, dust, scratches, and other substances and/or occurrences that would potentially damage portable electronic device 101. An advantage of the second described embodiment is that portable electronic device 101 is more readily accessible, as are any buttons or other controls thereof.

Figure 5:
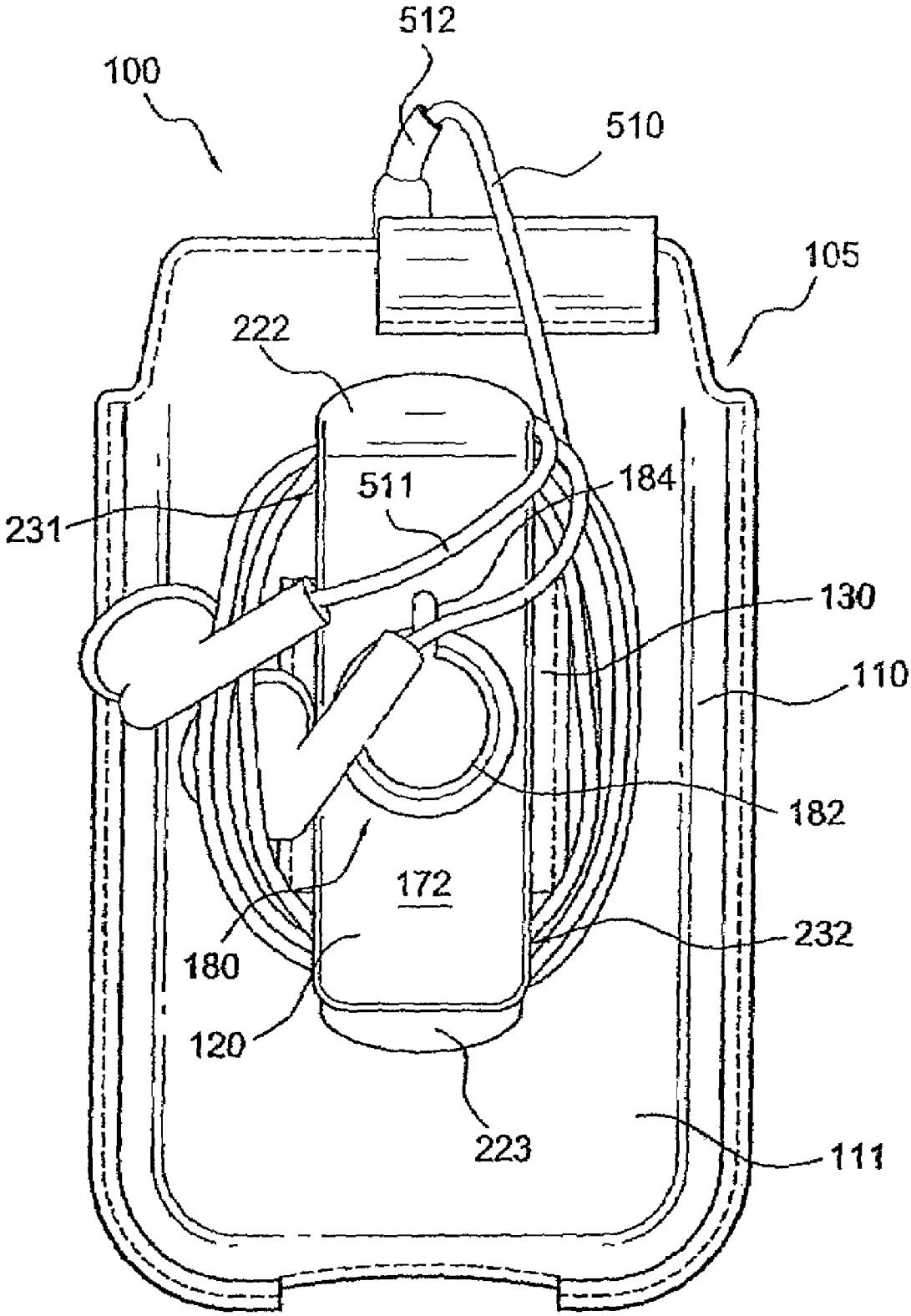
FIG. 5 is a front view of the attachment mechanism of FIG. 1 with a cord arranged thereon according to an embodiment of the invention.

FIG. 5 is a front view of attachment mechanism 100 showing a cord 510 arranged thereon according to an embodiment of the invention. As depicted in FIG. 5, cord 510 comprises a headphone cord, though attachment mechanism 100 also functions well with other cord types, as mentioned above. As shown, cord 510 has been wrapped around clip 120 such that portions of cord 510 are in pocket 231 and other portions of cord 510 are in pocket 232. A portion 511 of cord 510 has been left outside of pockets 231 and 232 and is shown to be hanging freely from clip 120. Portion 511 of cord 510 may easily be moved aside so that it does not block access to openings 182 or 184. Case 110 may thus easily be mounted on mounting piece 300 (see FIG. 3) even when cord 510 is arranged on clip 120. A portion 512 of cord 510 is also left outside of pockets 231 and 232 in order to be able to plug into portable electronic device 101 (see FIG. 1).

Figure 6:
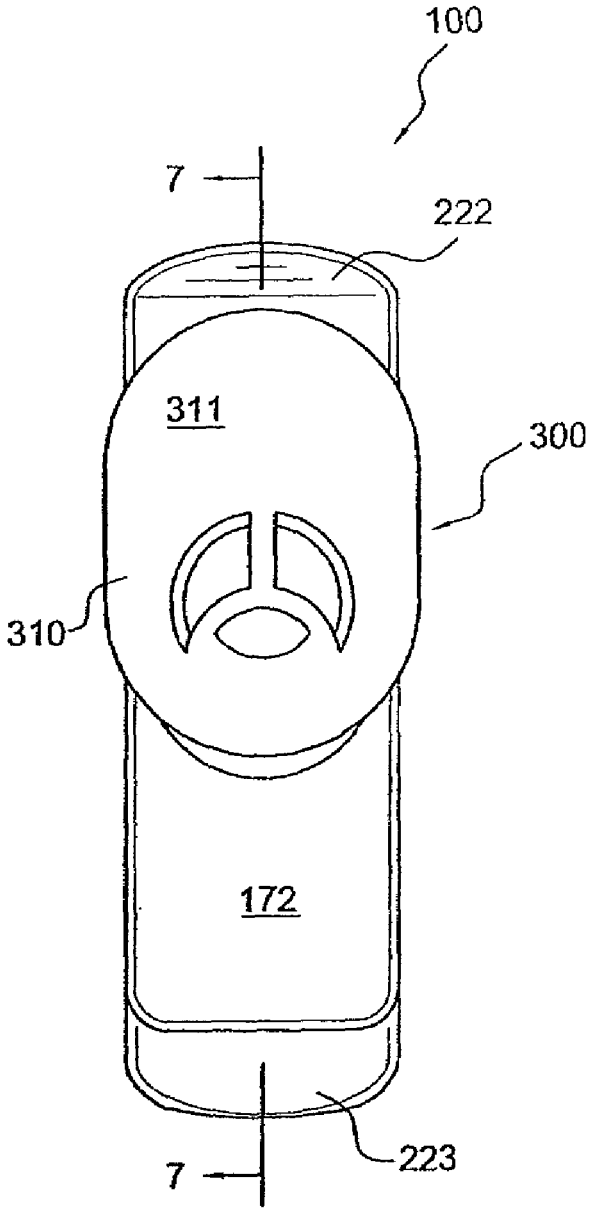
FIG. 6 is a front view of the attachment mechanism of FIG. 1 showing the mounting piece of FIG. 3 attached thereto.
Figure 7:
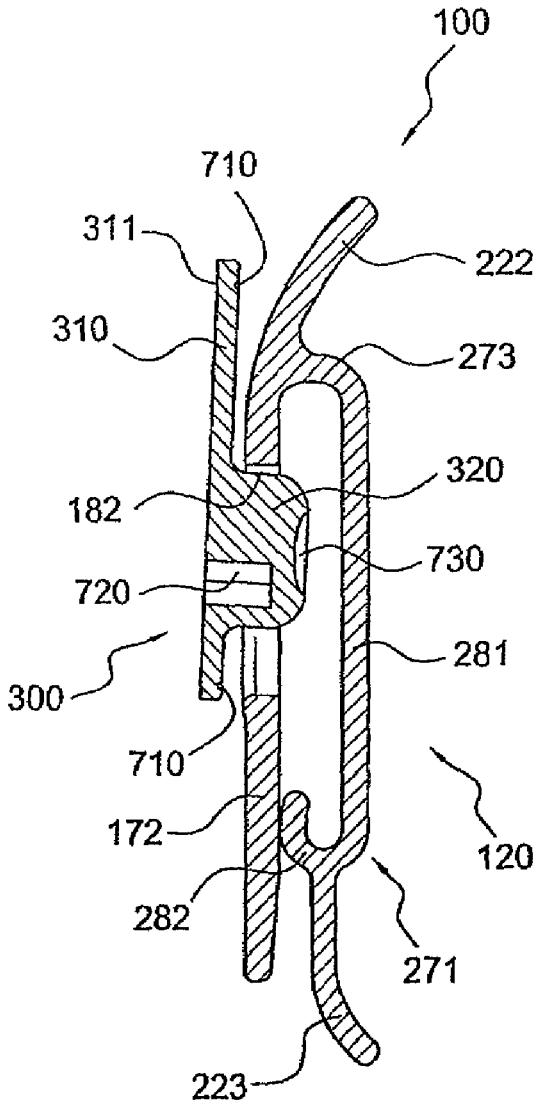
FIG. 7 is a cross section taken along line 7-7 of FIG. 6.

FIG. 6 is a front view of attachment mechanism 100 showing mounting piece 300 attached thereto according to an embodiment of the invention. FIG. 7 is a cross section taken along line 7-7 of FIG. 6 according to an embodiment of the invention. Additional details pertaining to mounting piece 300, and the portions of clip 120 that interact therewith, were described above in connection with FIGS. 1-3.

As illustrated in FIG. 7, mounting piece 300 comprises a groove 710 in backing piece 310. In embodiments where mounting piece 300 is sewn into an item such as those mentioned above, groove 710 receives stitching introduced by the sewing process. In the illustrated embodiment, mounting piece 300 further comprises a hollow 720. Hollow 720 is created during the manufacturing process when a portion of backing piece 310 is cored out in order to minimize the amount of material used and/or to improve the appearance of mounting piece 300. Mounting piece 300 still further comprises a depression 730. One function of depression 730 is to affect the appearance of mounting piece 300. Another function of depression 730 is to act as locking feature for mounting piece 300. To perform the latter function, depression 730 receives and arrests the motion of a protuberance (not shown) attached to clip 120 or another item to which mounting piece 300 is attached. Depression 730 and the protuberance then act as a positive locking feature to improve the stability of attachment mechanism 100.

Figure 8:
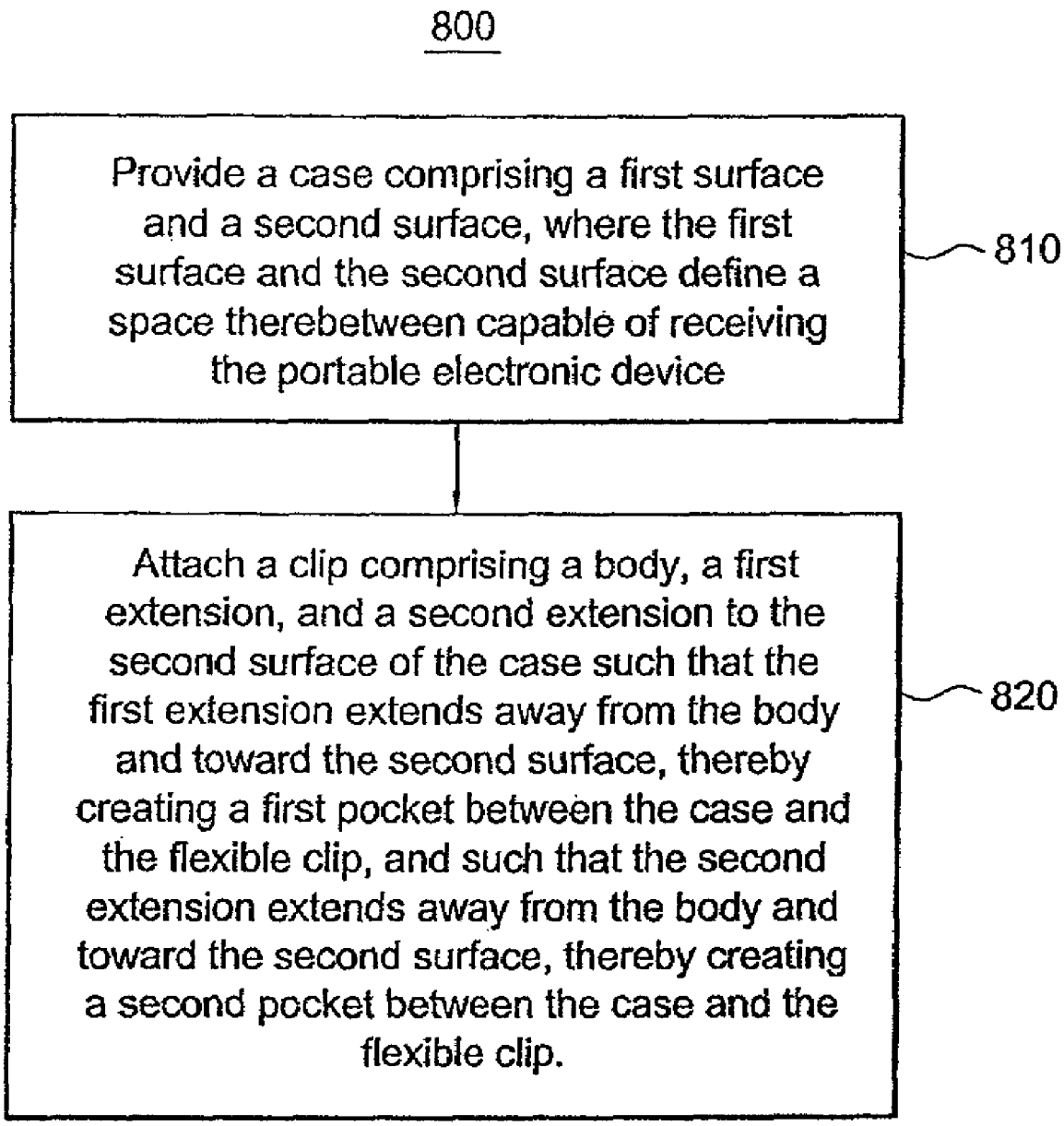
FIG. 8 is a flow chart illustrating a method of manufacturing an attachment mechanism for use with a portable electronic device.

FIG. 8 is a flow chart illustrating a method 800 of manufacturing an attachment mechanism for use with a portable electronic device. A step 810 of method 800 is to provide a case comprising a first surface and a second surface, where the first surface and the second surface define a space therebetween capable of receiving the portable electronic device. As an example, the case, the first surface, the second surface, and the space can be similar to, respectively, case 110, surface 111, surface 211, and space 105. Case 110, surface 111, and space 105 were first shown in FIG. 1, while surface 211 was first shown in FIG. 2. As another example, the portable electronic device can be similar to portable electronic device 101, first shown in FIG. 1.

A step 820 of method 800 is to attach a clip comprising a body, a first extension, and a second extension to the second surface of the case such that the first extension extends away from the body and toward the second surface, thereby creating a first pocket between the case and the flexible clip, and such that the second extension extends away from the body and toward the second surface, thereby creating a second pocket between the case and the flexible clip. As an example, the clip, the body, the first extension, and the second extension can be similar to, respectively, clip 120, first shown in FIG. 1, and body 221, extension 222, and extension 223, all of which were first shown in FIG. 2. As another example, the second surface, the body, the first pocket, and the second pocket can be similar to, respectively, surface 111, first shown in FIG. 1, and body 221, pocket 231, and pocket 232, all of which were first shown in FIG. 2.

In one embodiment, step 820 comprises sewing the clip to the case. In the same or another embodiment, step 820 or another step comprises: providing a patch and a spacer; positioning a portion of the clip between the patch and the case; positioning the spacer between the case and a portion of the patch; and sewing the patch to the case by stitching through the patch, the spacer, and the second surface of the case. If desired, the spacer may be painted or colored so that it is the same color as the patch and/or the case. In different embodiments, step 820 comprises adhering the clip to the case using an adhesive, or attaching the clip to the case using rivets or the like.

Although the invention has been described with reference to specific embodiments, it will be understood by those skilled in the art that various changes may be made without departing from the spirit or scope of the invention. Various examples of such changes have been given in the foregoing description. Accordingly, the disclosure of embodiments of the invention is intended to be illustrative of the scope of the invention and is not intended to be limiting. It is intended that the scope of the invention shall be limited only to the extent required by the appended claims. For example, to one of ordinary skill in the art, it will be readily apparent that the attachment mechanism discussed herein may be implemented in a variety of embodiments, and that the foregoing discussion of certain of these embodiments does not necessarily represent a complete description of all possible embodiments. Rather, the detailed description of the drawings, and the drawings themselves, disclose at least one preferred embodiment of the invention, and may disclose alternative embodiments of the invention.

All elements claimed in any particular claim are essential to the invention claimed in that particular claim. Consequently, replacement of one or more claimed elements constitutes reconstruction and not repair. Additionally, benefits, other advantages, and solutions to problems have been described with regard to specific embodiments. The benefits, advantages, solutions to problems, and any element or elements that may cause any benefit, advantage, or solution to occur or become more pronounced, however, are not to be construed as critical, required, or essential features or elements of any or all of the claims.

Moreover, embodiments and limitations disclosed herein are not dedicated to the public under the doctrine of dedication if the embodiments and/or limitations: (1) are not expressly claimed in the claims; and (2) are or are potentially equivalents of express elements and/or limitations in the claims under the doctrine of equivalents.

What is claimed is:

1. An attachment mechanism for use with a portable electronic device, the attachment mechanism comprising:

a case comprising a first surface and a second surface, where the first surface and the second surface define therebetween a space capable of receiving the portable electronic device;

a flexible clip attached to the second surface of the case and comprising a body, a first extension, and a second extension; and a mounting piece comprising a backing piece and a protrusion extending from the backing piece, wherein:

the body comprises a first section, a second section, and a third section connecting the first section and the second section;

the first section is mounted flush with the second surface;

the first extension extends away from the third section and toward the second surface, thereby creating a first pocket between the case and the flexible clip;

the second extension extends away from the first section and toward the second surface, thereby creating a second pocket between the case and the flexible clip;

the second section of the flexible clip comprises an inside perimeter;

the inside perimeter comprises:

a first portion that defines a first opening in the second section capable of receiving the protrusion of the mounting piece; and a second portion that defines a second opening in the second section;

the second opening communicates with the first opening; and the second opening is more narrow than the first opening.

2. The attachment mechanism of claim 1 wherein:

the first extension is long enough to touch the second surface; and the second extension is long enough to touch the second surface.

3. The attachment mechanism of claim 1 wherein:

the first section of the flexible clip comprises a first segment and a second segment;

the first segment is substantially straight and flat and is mounted flush with the second surface; and the second segment extends away from the first segment toward the second section.

4. The attachment mechanism of claim 1 wherein:

the mounting piece further comprises a locking piece extending from the protrusion;

the second opening is capable of receiving the locking piece; and the flexible clip is prevented from rotating about the protrusion when the locking piece is located in the second opening.

5. The attachment mechanism of claim 4 wherein:

the backing piece is substantially flat; and the backing piece comprises a self-adhesive surface.

6. The attachment mechanism of claim 5 wherein:

the first section of the flexible clip comprises a first segment and a second segment;

the second segment extends away from the first segment toward the second section; and the second segment is long enough to touch the second section.

7. The attachment mechanism of claim 6 wherein:

the first surface comprises a viewing window.

8. The attachment mechanism of claim 1 wherein:

the case further comprises a patch attached to the second surface; and the patch is between the first section of the flexible clip and the second section of the flexible clip.

9. The attachment mechanism of claim 8 wherein:

the case further comprises a spacer sewn between the second surface and the patch.

10. The attachment mechanism of claim 8 wherein:

the patch is sewn to the second surface of the case.

11. The attachment mechanism of claim 10 wherein:

the first surface comprises a viewing window.

12. The attachment mechanism of claim 1 wherein:

the first pocket is configured to receive a first portion of a headphone cord; and the second pocket is configured to receive a second portion of the headphone cord concurrent with the first pocket receiving the first portion of the headphone cord.

13. The attachment mechanism of claim 1 wherein:

the first extension is long enough to touch the second surface.

14. The attachment mechanism of claim 1 wherein:

the second extension is long enough to touch the second surface.

15. The attachment mechanism of claim 1 wherein:

the first section of the body of the flexible clip comprises a first segment and a second segment; and the first segment is mounted flush with the second surface.

16. The attachment mechanism of claim 1 wherein:

the mounting piece further comprises a locking piece extending from the protrusion.

17. The attachment mechanism of claim 16 wherein:

the second opening is capable of receiving the locking piece.

18. The attachment mechanism of claim 1 wherein:

the backing piece is substantially flat.

19. The attachment mechanism of claim 1 wherein:

the first section of the body of the flexible clip comprises a first segment and a second segment; and the second segment extends away from the first segment toward the second section.

20. The attachment mechanism of claim 1 wherein:

the first section of the body of the flexible clip comprises a first segment and a second segment; and the second segment is long enough to touch the second section.

21. The attachment mechanism of claim 1 wherein:

the case further comprises a patch attached to the second surface.

22. The attachment mechanism of claim 21 wherein:

the patch is sewn to the second surface of the case.

23. The attachment mechanism of claim 21 wherein:

the case further comprises a spacer sewn between the second surface and the patch.

* * * * *